US005150600A

United States Patent [19]

Wentzek et al.

[11] Patent Number: 5,150,600

[45] Date of Patent: Sep. 29, 1992

[54] RESILIENT MEMBER NESTING APPARATUS

[75] Inventors: Horst Wentzek; Michael Kozak, both of Kenosha, Wis.

[73] Assignee: Frank L. Wells Company, Kenosha, Wis.

[21] Appl. No.: 643,725

[22] Filed: Jan. 22, 1991

[51] Int. Cl.[5] ..... B21D 45/00; B21F 35/04

[52] U.S. Cl. ..... 72/426; 72/169; 140/71 R

[58] Field of Search ..... 72/133, 134, 166, 169, 72/426, 427; 140/71 R, 89; 29/173; 53/114, 537

[56] References Cited

U.S. PATENT DOCUMENTS

| | | | |
|---|---|---|---|
| 2,476,745 | 7/1949 | Leech | 72/427 |
| 2,719,562 | 10/1955 | Beegle | 72/134 |
| 2,889,866 | 7/1959 | Braun | 72/427 |
| 3,416,287 | 12/1968 | Hawkins et al. | 53/119 |
| 3,825,985 | 7/1974 | Meitinger | 72/426 |
| 4,121,628 | 10/1978 | Waligore et al. | 140/105 |
| 4,270,582 | 6/1981 | Norman | 72/133 |

OTHER PUBLICATIONS

One page advertisement "The Eleven States Nester".

*Primary Examiner*—Robert L. Spruill
*Assistant Examiner*—Donald M. Gurley
*Attorney, Agent, or Firm*—Michael, Best & Friedrich

[57] ABSTRACT

A resilient member handling apparatus comprising a frame, a mechanism on the frame for bowing successive resilient members, and a mechanism on the frame for forming a nested complement of the resilient members, the mechanism for forming including a first cage member stationarily mounted on the frame, and defining a primary chamber adapted to receive a resilient member, a second cage member stationarily mounted on the frame, and defining a secondary chamber adapted to receive a plurality of the resilient members, a mechanism for feeding resilient members one at a time into the primary chamber from the mechanism for bowing, and a mechanism for transferring the resilient members one at a time from the primary chamber to the secondary chamber.

24 Claims, 4 Drawing Sheets 142
70
148
144

112
116
106
100
150
154
158
120
108
24
110
156
98
146
152
16
18

RESILIENT MEMBER NESTING APPARATUS

BACKGROUND OF THE INVENTION

1. Field of the Invention

The invention relates generally to resilient member handling apparatus, and, more particularly, to nesting apparatus for arranging a plurality of arcuate resilient members in nested relation.

2. Reference to the Prior Art

Wire deforming machines are known in the art and include zig zag machines which are used to permanently bend resilient members, such as wires, into a sinuous configuration. Machines for permanently bowing individual resilient members into a circular or arcuate hoop are also known in the art. Thus, the sinuously shaped wire produced by the zig zag machine can be cut to discrete lengths and permanently bowed in the bowing machine to form arcuate springs which are useful in such industries as the furniture making industry.

A prior art nesting machine for arranging the arcuate springs in nested relation to each other includes a single primary chamber from which the arcuate springs are transferred to one of a plurality of secondary chambers. The secondary chambers are movable relative to the primary chamber and are sequentially positioned adjacent the primary chamber to receive a complement of the springs, and then adjacent an ejector to eject the springs from the successive secondary chambers.

SUMMARY OF THE INVENTION

The invention provides a nesting apparatus for positioning resilient members in nested relation, the nesting apparatus comprising a frame, means stationarily mounted on the frame for defining a primary chamber adapted to receive a resilient member, means stationarily fixed on the frame for defining a secondary chamber adapted to receive a plurality of the resilient members, means on the frame for feeding resilient members one at a time into the primary chamber, and means on the frame for transferring resilient members one at a time from the primary chamber to the secondary chamber to form a nested complement of the resilient members in the secondary chamber.

The invention also provides a nesting apparatus for positioning resilient members in nested relation, the nesting apparatus comprising a frame, means on the frame for defining a primary chamber adapted to receive a resilient member, means on the frame for defining a secondary chamber adapted to receive a plurality of resilient members in nested relation, means on the frame for transferring resilient members one at a time from the primary chamber to the secondary chamber, and means positionable within the secondary chamber for restricting angular movement of the resilient members transferred to the secondary chamber.

The invention also provides a resilient member handling apparatus comprising a frame, means on the frame for bowing successive resilient members, and means for forming a nested complement of the resilient members, the means for forming including a first cage member stationarily mounted on the frame, and defining a primary chamber adapted to receive a resilient member, a second cage member stationarily mounted on the frame, and defining a secondary chamber adapted to receive a plurality of the resilient members, means for feeding resilient members one at a time into the primary chamber from the means for bowing, and means for transferring the resilient members one at a time from the primary chamber to the secondary chamber.

The invention also provides a resilient member handling apparatus comprising a frame, means on the frame for bowing successive resilient members, the means for bowing including a die member having an arcuate surface portion, and means adjacent the arcuate surface portion for urging successive resilient members into engagement therewith, and means for forming a nested complement of resilient members, the means for forming including a stationary first cage member fixed on the frame, the first cage member defining a generally cylindrical primary chamber adapted to receive a resilient member, and a chamber entryway communicating with the primary chamber, means for defining a generally cylindrical secondary chamber coaxially aligned with the primary chamber, the means for defining including a stationary second cage member fixed on the frame, and adapted to receive a plurality of resilient members, an ejector plate moveable within the secondary chamber relative to the second cage member between a complement retaining position and an ejecting position, the ejector plate having therein a central opening, and being adapted to eject the nested complement of resilient members from the secondary chamber, and a removeable cover adapted to selectively contain the resilient members within the secondary chamber, means on the frame for successively transferring resilient members one at a time from the primary chamber to the secondary chamber, the means for transferring including a head member moveable between a retracted position wherein the head member is positioned within the primary chamber, and an extended position wherein the head member is positioned within the secondary chamber, the head member including a base, and an annular wall extending from the base, having therein a slot, and dividing the primary chamber into an outer portion and an inner portion when the head member is in the retracted position, means for moving the head member through the central opening and between the retracted and extended positions after each resilient member is fed into the primary chamber, and means for feeding resilient members one at a time into the primary chamber from the means for bowing, the means for feeding including a door located at least partially over the chamber entryway, and supported on the frame for pivotal movement relative thereto between an opened position and a closed position, the door being adapted to engage successive resilient members so that the door is pivoted to the opened position as each resilient member is fed into the primary chamber, and to direct resilient members into the outer portion for travel around the annular wall and then through the slot and into the inner portion, and a stop member radially extendable into the secondary chamber, the stop member being adapted to engage each successive resilient member transferred to the secondary chamber to restrict angular movement thereof so that successive resilient members nest in previously transferred resilient members to form the nested complement in the secondary chamber.

A principal feature of the invention is the provision of a nesting apparatus which automatically arranges a plurality of resilient members, such as arcuate wire springs, into nested relation with one another, and which includes a stationary primary chamber in which successive resilient members are temporarily coiled, a mechanism for transferring the coiled resilient member to a stationary secondary chamber where it uncoils, and an angular stop member positionable within the secondary chamber to restrict angular movement of the uncoiled or partially uncoiled resilient member so that the resilient member automatically assumes a nested position relative to resilient members previously deposited in the secondary chamber.

Other features and advantages of the invention will become apparent to those skilled in the art upon review of the following detailed description, claims, and drawings.

Figure 1:
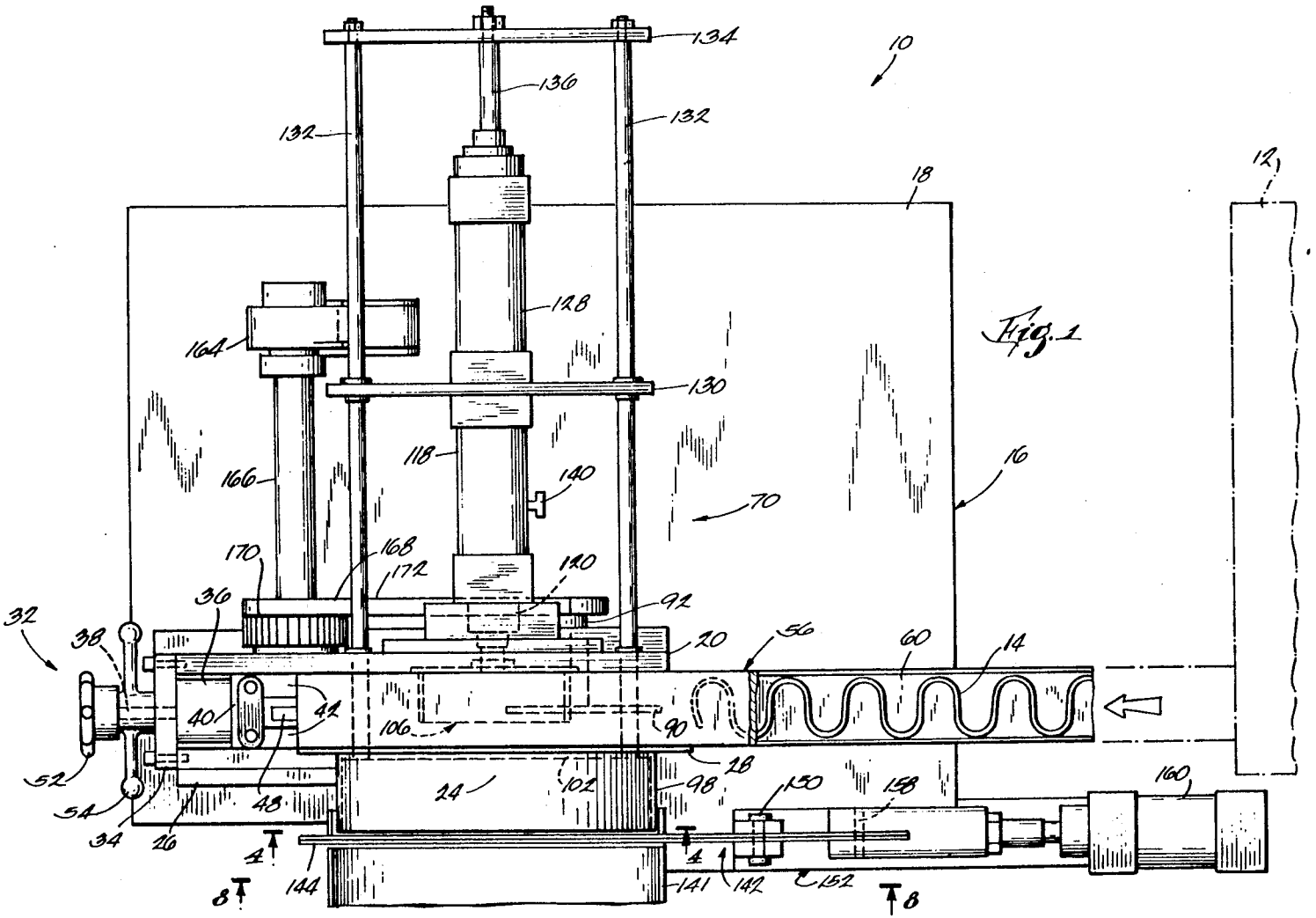
FIG. 1 is a fragmentary top elevational view, partially in section, of a resilient member handling apparatus including a nesting apparatus embodying various of the features of the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in FIG. 1 is a resilient member handling apparatus 10 machine such as the schematically shown zig zag machine 12. Resilient members 14 produced by the zig zag machine preferably have a sinusoidal waveform, as shown in FIG. 1, and are cut to discrete lengths and then fed into the handling apparatus 10. While the handling apparatus 10 is capable of handling the resilient members 14 produced by the zig zag machine 12, the handling apparatus is also capable of handling resilient members having various different configurations for use in a variety applications.

Figure 2:
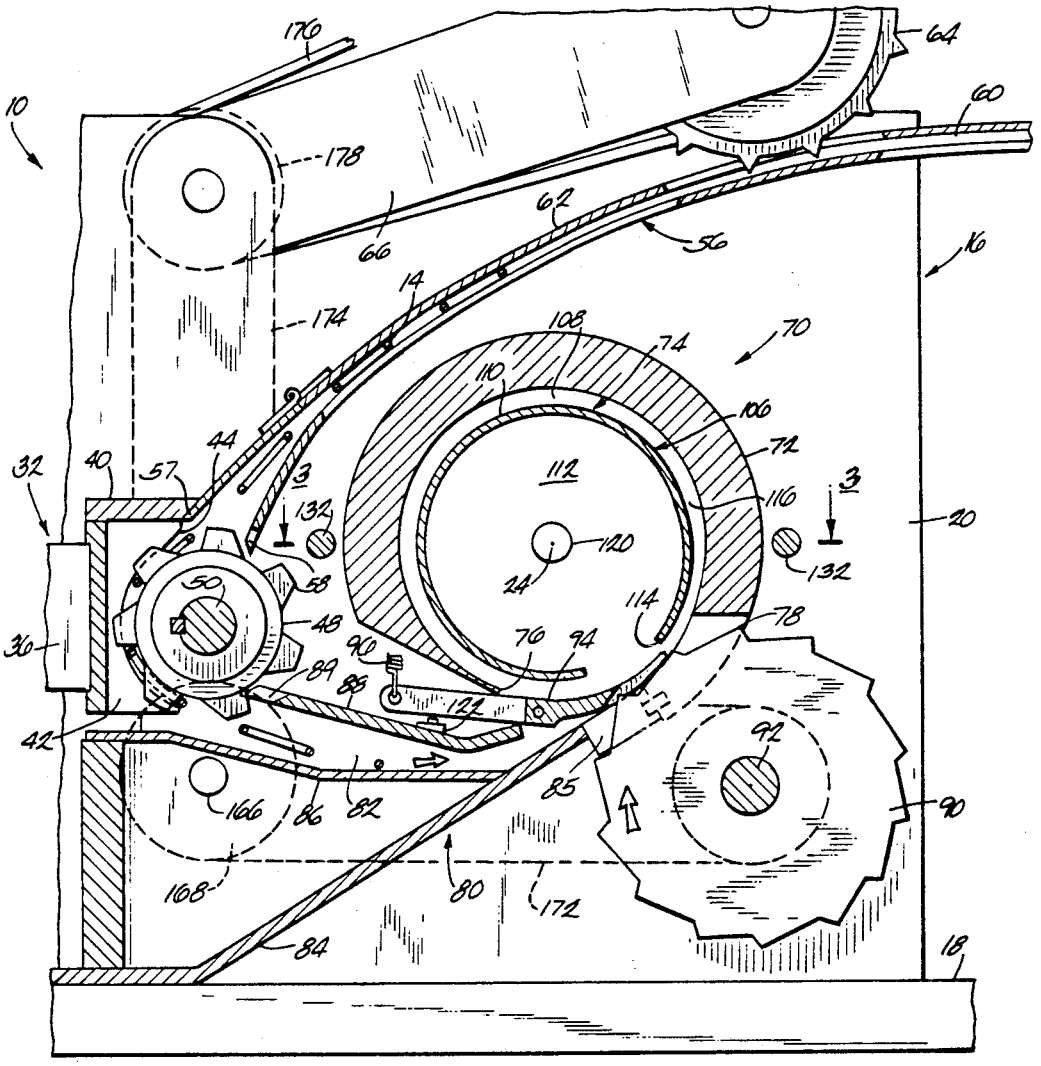
FIG. 2 is an enlarged and fragmentary front view, partially in section, of the handling apparatus shown in FIG. 1.
Figure 3:
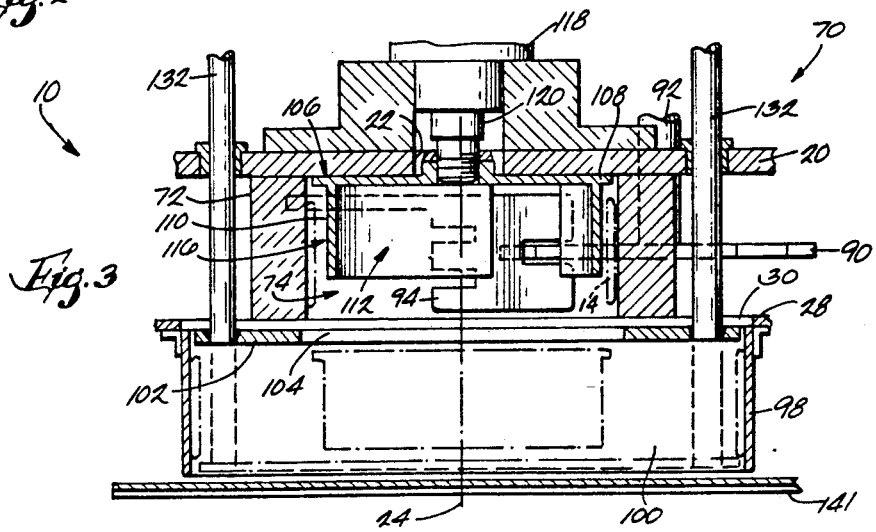
FIG. 3 is a view taken along line 3—3 of FIG. 2.

As shown in FIGS. 1 and 2, the handling apparatus 10 comprises a frame 16 including a base plate 18, and an L-shaped main support 20. The main support 20 extends upwardly from the base plate 18 and has therein a centrally located circular hole 22 including an axis 24 (FIG. 3). The frame 16 also includes an L-shaped secondary support 26, and an upright support plate 28 extending from the secondary support 26 and having therein a generally circular opening 30 preferably coaxially aligned with the hole 22 in the main support 20. Both the secondary support 26 and the support plate 28 are mounted on the base plate 18 in spaced apart, generally parallel relation to the main support 20. The components of the frame 16 can be securely joined together by any suitable means such as with fasteners or weldments.

The handling apparatus 10 also comprises means for bending or bowing successive resilient members 14 fed to the handling apparatus 10 from zig zag machine 12. While various bowing means can be employed, in the illustrated construction, the bowing means includes a bowing apparatus 32 (FIG. 2) which is positioned between the main and secondary supports 20 and 26, and which functions to permanently bend or bow the resilient members 14, thereby forming curved or arcuate springs. As shown in FIG. 2, the bowing apparatus 32 includes a mounting plate 34 secured between the main and secondary supports 20 and 26 via fasteners, and a support block 36 including a threaded member 38 which is threadingly received in the mounting plate 34 so that the support block 36 is linearly moveable relative to the mounting plate 34. A slotted die member 40 is mounted on the support block 36 and includes a pair of spaced apart die halves 42 each having an arcuate surface portion 44.

The bowing apparatus 32 also includes means for urging successive resilient members 14 into engagement with the arcuate surface portions 44 of the die halves 42. While various urging means can be employed, in the illustrated construction, the urging means includes a die wheel 48 mounted on one end of a shaft 50 which is journaled in the main support 20. The die wheel 48 is fixed between the die halves 42 so that the die wheel 48 travels through the slot between the die halves 42. When the die wheel 48 is driven it conveys successive resilient members 14 into contact with the arcuate surface portions 44. The radius of curvature of the curved or arcuate resilient members 14 formed by the bowing apparatus 32 can be varied by twisting a knob 52 on the threaded member 38 to move the die member 40 relative to the die wheel 48. A locking nut 54 can be tightened to secure the die member 40 in the desired position.

The handling apparatus 10 also includes means for feeding successive resilient members 14 from the zig zag machine 12 to the bowing apparatus 32. While various bowing apparatus feeding means can be employed, in the illustrated construction, the bowing apparatus feeding means includes an upper guide apparatus 56. The guide apparatus 56 extends from the zig zag machine 12 and curves downwardly between the main support 20 and the support plate 28, terminating at a lower end having a top portion 57 contacting the die member 40, and a slotted lower portion 58 for accomodating the die wheel 48. The upper guide apparatus 56 defines an upper shoot 60 which opens in the area closely adjacent the bowing apparatus 32, and includes a cover 62 hinged to the rest of the upper guide apparatus 56. The cover portion 62 provides access to the upper shoot 60 to clear obstructions or to remove jammed resilient members 14 therefrom.

While in the illustrated arrangement the upper guide apparatus 56 is incorporated into the handling apparatus 10, in other arrangements the upper guide apparatus 10 can be part of the zig zag machine 12.

While the zig zag machine 12 is typically capable of conveying the resilient members 14 down the upper shoot 60 to the bowing apparatus 32, in the illustrated arrangement, the feeding means is provided with an optional auxiliary feed wheel 64 to assist the zig zag machine 12. The auxiliary feed wheel 64 extends into the upper shoot 60 through an opening in the upper guide apparatus 56 for conveying the resilient members 14 one at a time down the upper shoot 60 to the bowing apparatus 32. The auxiliary feed wheel 64 is supported on an arm member 66 which is pivotally supported on the main support 20 so that the auxiliary feed wheel 64 can be moved to allow the cover portion 62 to be opened.

The handling apparatus 10 also comprises a nesting apparatus 70 for automatically arranging the resilient members 14 in nested relation to one another to form a compact bundle or nested complement of the resilient members 14. The nesting apparatus 70 includes means for defining a primary chamber. While various primary chamber defining means can be employed, in the illustrated construction, the primary chamber defining means includes a first cage member 72 stationarily mounted on the main support 20. The first cage member 72 defines a generally cylindrical primary chamber 74 which is coaxial with the hole 22 in the main support 20, and includes an axial opening which defines a primary chamber entryway 76. The first cage member 72 also includes a slotted portion 78 (FIG. 2) adjacent the entryway 76.

The nesting apparatus 70 also includes means for feeding resilient members 14 one at a time into the primary chamber 74 from the bowing apparatus 32. While various primary chamber feeding means can be employed, in the illustrated construction, the feeding means includes a lower guide apparatus 80 which defines a lower shoot 82. The lower shoot 82 forms a mouth closely adjacent the area into which the resilient members 14 exit from the bowing apparatus 32, and an exit adjacent the entryway 76. The lower guide apparatus 80 includes a slanted first guide member 84 having a slotted upper end 85 coextensive with the slotted portion 78 of the first cage member 72, a lower transverse guide member 86, and an upper transverse guide member 88 spaced above the lower transverse guide member 86. The upper transverse guide member 88 has a slotted end 89 positioned to accomodate the die wheel 48 and to prevent the resilient members 14 from escaping the lower shoot 82.

The primary chamber feeding means also includes a main feed wheel 90 mounted on a shaft 92 which is journaled in the main support 20. The main feed wheel 90 is positioned adjacent the entryway 76, and travels through the slotted portion 78 of the first cage member 72 and the slotted end 85 of the slanted guide member 84 to engage and feed the resilient members 14 one at a time directly into the primary chamber 74.

Figure 5:
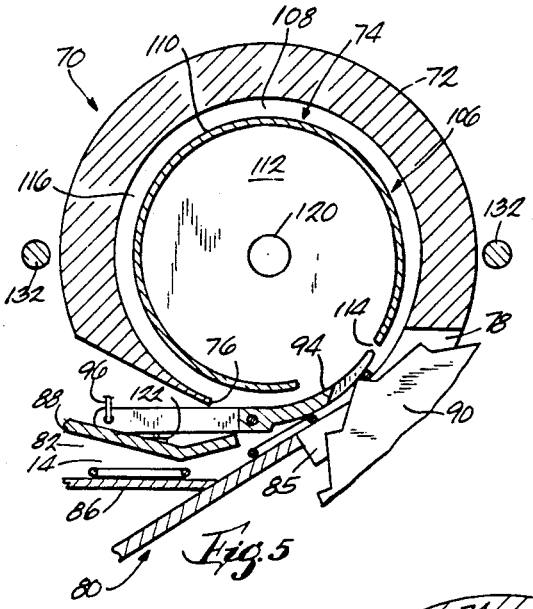
FIG. 5 is a view of the nesting apparatus shown in FIG. 2, and shows a resilient member entering the nesting apparatus.

The primary chamber feeding means also includes a door 94 pivotally supported on the main support 20 for movement between an opened position (FIGS. 5 and 6) and a closed position (FIG. 7), as will be further discussed below. A helical spring 96 is connected between the main support 20 and one end of the door 94 to bias the door 94 toward the closed position. The door 94 extends across or over the entryway 76, and separates the lower shoot 82 from the primary chamber 74. The door 94 is also slotted to accomodate the main feed wheel 90.

The nesting apparatus 70 also includes means for defining a secondary chamber. While various secondary chamber defining means can be employed, in the illustrated construction, the secondary chamber defining means includes a tubular second cage member 98 stationarily mounted on the support plate 28 over the opening 30. The second cage member 98 defines a generally cylindrical secondary chamber 100 which is coaxially aligned with the primary chamber 74, and which has a radius larger than the radius of the primary chamber 74.

The secondary chamber defining means also includes a circular ejector plate 102 having therein a central opening 104. As shown in FIG. 3, the ejector plate 102 is moveable within the secondary chamber 100 relative to the second cage member 98 between a complement retaining position (shown in solid lines), and a complement ejecting position (shown in broken lines).

The nesting apparatus 70 also includes means for transferring the resilient members 14 one at a time from the primary chamber 74 to the secondary chamber 100. While various transferring means can be employed, in the illustrated construction, the transferring means includes a head member 106. As shown in FIG. 3, the head member 106 is moveable between a retracted position (shown in solid lines) wherein the head member is positioned in the primary chamber 74, and an extended position (shown in broken lines) wherein the head member extends through the opening 104 in the ejector plate 102 and into the secondary chamber 100.

Figure 6:
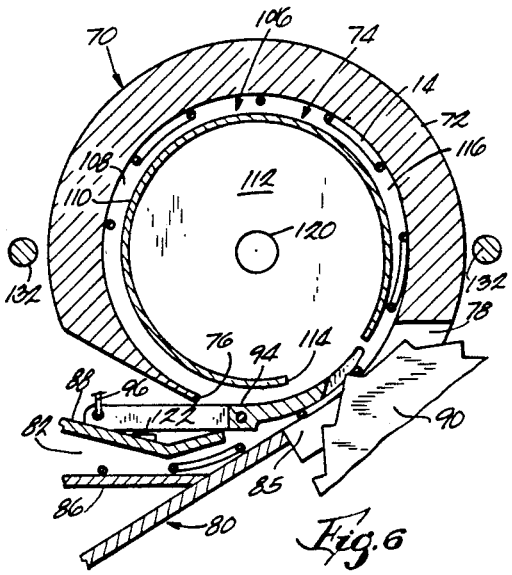
FIG. 6 is a view similar to FIG. 5, and shows a resilient member partially within the nesting apparatus.
Figure 7:
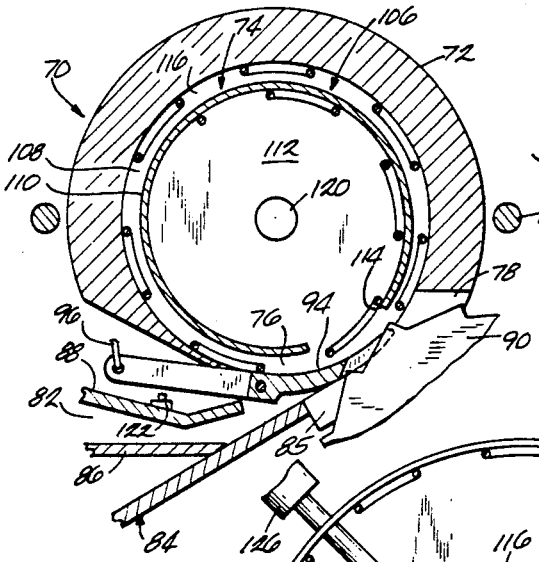
FIG. 7 is a view similar to FIG. 5, and shows a resilient member after it is fed entirely into the nesting apparatus.

The head member 106 includes a circular pusher plate or base 108, and an annular wall 110 extending from the base 108 and defining an interior space 112. The annular wall 110 has an axial slot 114, and divides the primary chamber 74 into an inner portion corresponding to the interior space 112, and a tordially-shaped or donut-shaped outer portion 116 when the head member 106 is in the retracted position. As will be further explained below, resilient members 14 engage the door 94 and pivot the door 94 to the opened position when they are fed into the primary chamber 74 by the main feed wheel 90. With the door 94 in the opened position and the head member in the retracted position, resilient members 14 entering the primary chamber 74 are first directed by the door 94 into the outer portion 116 (FIG. 5) for travel around the annular wall 110 (FIG. 6). After the resilient member 14 encircles the annular wall 110, it is then directed by the door 94 through the slot 114 and into the interior space 112 so that the resilient member 14 is resiliently coiled or wrapped within the primary chamber 74.

The means for transferring also includes means for moving the head member 106 between the retracted and extended positions after a resilient member 14 is coiled completely within the primary chamber to transfer the coiled resilient member to the secondary chamber. While various moving means can be employed, in the illustrated construction, the moving means includes a first cylinder assembly 118 mounted on the main support 20. The first cylinder assembly 118 is preferably pneumatic and includes a rod 120 which is connected to the base 108 of the head member 106, and which extends through the hole 22 in the base plate 18.

The means for moving is provided with means for actuating the first cylinder assembly 118 only after a resilient member 14 is fed completely into the primary chamber 74. While various actuating means can be employed, in the illustrated construction, the actuating means includes means for sensing the position of the door 94. The door position sensing means includes a microswitch 122 which is supported on the main support 20, and which is engaged each time the door 94 is opened by the entry of a resilient member into the primary chamber 74. When the door 94 returns to the closed position after the resilient member has entirely entered the primary chamber 74, the microswitch 122 signals actuation of the first cylinder assembly 118 to move the head member 106 through one complete cycle from the retracted position to the extended position and back to the retracted position to move the resilient member to the secondary chamber 100.

Figure 4:
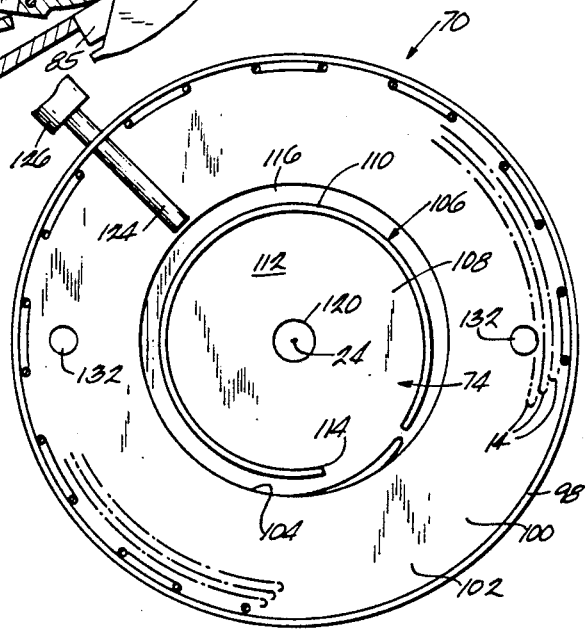
FIG. 4 is an enlarged and fragmentary view taken along line 4—4 of FIG. 1.

The nesting apparatus 70 can also include means for restricting angular movement of successive resilient members 14 within the secondary chamber 100. While various restricting means can be employed, in the illustrated construction, the restricting means includes an angular stop member 124, and a second preferably pneumatic cylinder assembly 126 supported on the support plate 28 for moving the angular stop member 124 between a first position wherein the stop member extends radially into the secondary chamber 100 (FIG. 4), and a second position (not shown) wherein the stop member is withdrawn from the secondary chamber 100. Since the secondary chamber 100 has a greater radius than the primary chamber 74, the resilient members 14 tend to at least partially unwrap or uncoil from around the annular wall 106 when transferred to the secondary chamber 100. When in the first position, the angular stop member 124 is designed to engage each successive resilient member 14 in approximately the same location as it uncoils from around the annular wall 106, thereby restricting angular movement of at least a portion of the resilient member 14. As the head member 106 is retracted from the secondary chamber 100 through the opening 104 in the ejector plate 102, the resilient member 14 engages the ejector plate 102 and that portion of the resilient member 14 within the interior portion 112 of the head member 106 is freed from the head member 106. Thereafter, the angular stop member 124 continues to restrain angular movement of the resilient member 14 as it uncoils further and nests with resilient members 14 already within the secondary chamber 100 to form a nested complement.

The nesting apparatus 70 also includes means for ejecting the nested complement of resilient members 14 from the secondary chamber 100. While various ejecting means can be employed, in the illustrated construction, the ejecting means includes a third preferably pneumatic cylinder assembly 128 mounted in series relation to the first cylinder assembly 118, and supported by a support plate 130 fixed between the first and third cylinder assemblies 118 and 128. A pair of rods 132 extend through bushings located in each of the main support 20 and the support plate 130. The rods 132 are each secured on one end to the ejector plate 102 and on the other end to a force transmitting plate 134 which is in turn connected to the piston rod 136 of the third cylinder assembly 128.

The means for ejecting also includes control means for actuating the third cylinder assembly 128. In the illustrated arrangement, the control means includes a counter 140 which is incremented each time the first cylinder assembly 118 is actuated to transfer a resilient member 14 from the primary chamber 74 to the secondary chamber 100. When the desired number of resilient members 14 have been transferred to the secondary chamber 100, the counter 140 signals actuation of the third cylinder assembly 128 to move the ejector plate 102 through one complete cycle from the complement retaining position to the ejecting position and back to the retaining position so as to eject the nested complement from the secondary chamber 100 preferably into a tray 141.

Figure 8:
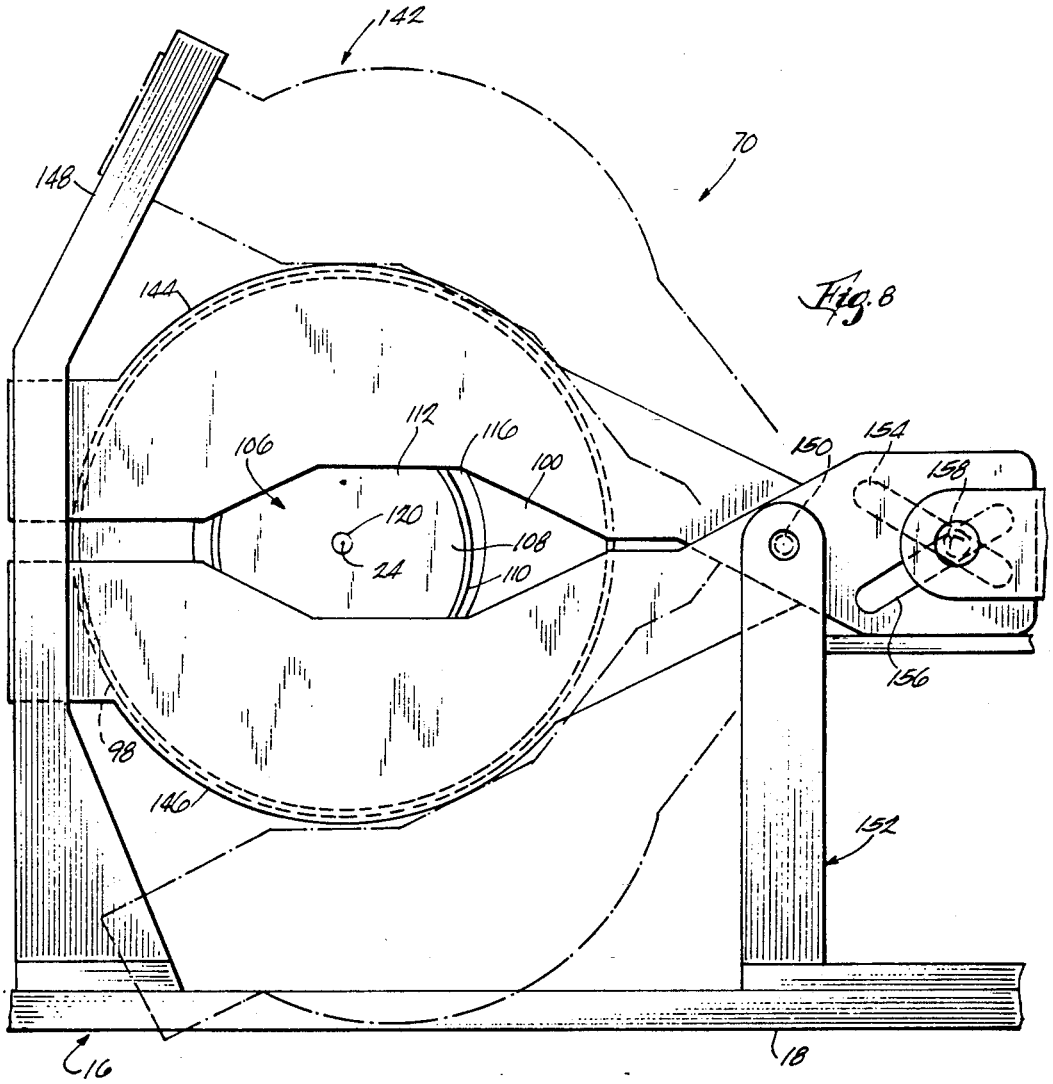
FIG. 8 is an enlarged and fragmentary view taken along line 8—8 of FIG. 1.

The nesting apparatus 70 also includes a scissors type cover apparatus 142 positionable over the secondary chamber 100 to retain resilient members 14 within the secondary chamber 100 while a nested complement is being formed. As shown in FIG. 8, the cover apparatus 142 includes upper and lower scissors members 144 and 146 which are supported on one end by a support guide 148, and which are pivotally joined at the other end by a pin 150 mounted on a support structure 152 connected to the base plate 18. The scissors members 144 and 146 include respective slots 154 and 156 which are oriented transversely to one another, and which each receive a pin 158.

The cover apparatus 142 also includes a fourth preferably pneumatic cylinder assembly 160 in tandem with the second cylinder assembly 126. The fourth cylinder assembly 160 is operably connected to the pin 158 and provides the scissors action to the scissors members or closures 144 and 146 to open and close the cover apparatus 142.

The handling apparatus 10 also includes means for driving the feed means and the bowing apparatus 32. While various driving means can be employed, in the illustrated construction, the driving means includes a drive motor 164 supported on the base plate 18, a drive shaft 166 extending from the drive motor 164 and journaled at one end on the main support 20, and a drive gear member 168 mounted on the drive shaft 166. The drive gear member 168 meshes with a second gear 170 supported on the end of the shaft 50 opposite the end on which the die wheel 48 is located to drive the die wheel 48. A chain or belt 172 from the drive gear member 168 drives the shaft 92 on which the main feed wheel 90 is supported. A pair of second chains or belts 174 and 176 and an auxillary drive wheel 178 cooperate to drive the auxillary feed wheel 64 from the drive gear member 168. The drive motor 164 preferably drives the auxillary feed wheel 64, die wheel 48, and main feed wheel 90 to convey the resilient members 14 through the handling apparatus 10 at a faster rate than they are received from the zig zag machine 12. Accelerating the resilient members 14 spaces them apart so that the time interval between entry of each successive member into the primary chamber 74 is sufficient to allow the head member 106 to move through one complete cycle before the succeeding resilient member is conveyed into the primary chamber 74.

In operation, successive sinuous resilient members 14 received by the handling apparatus 10 from the zig zag machine 12 are conveyed one at a time down the upper shoot 60 to the bowing apparatus 32 with the assistance of the auxillary feed wheel 64. Successive resilient members 14 are then engaged by the die wheel 48 and forced into contact with the arcuate surface portions 44 of the die member 40 to permanently bow each resilient member 14. The bowed resilient members 14 then enter the lower shoot 82 for subsequent engagement with the main feed wheel 90 which feeds the resilient members 14 one at a time into the primary chamber 74. As each resilient member 14 enters the primary chamber 74, it engages the door 94, pivoting the door 94 to the opened position to engage the microswitch 122. With the head member 106 in the retracted position, the opened door 94 guides the resilient member 14 first into the outer portion 116 of the primary chamber 74 where the resilient member 14 is resiliently wrapped or coiled around the outside of the annular wall 110, and then into the interior space 112 through the slot 114. When the resilient member 14 is entirely within the primary chamber 74, the door 94 closes to clear the way for extension of the head member 106, and to release the microswitch 122 to signal activation of the first cylinder assembly 118. The head member 106 then automatically moves to the extended position to transfer the resilient member 14 to the secondary chamber 100. Once in the secondary chamber 100, the resilient member 14 at least partially unwraps or uncoils from around the annular wall 110 and engages the angular stop member 124. Retracting the head member 106 from the secondary chamber 100 then causes the resilient member 14 to engage the ejector plate 102 to dislodge the resilient member 14 from the interior space 112. With angular movement restricted by the angular stop member 124, the just transferred resilient member 14 uncoils further, assuming a nested position in relation to the resilient members 14 previously transferred to the secondary chamber 100. The head member 106 thereafter automatically returns to the retracted position before the next successive resilient member 14 reaches the primary chamber 74. After a desired number of resilient members 14 have nested in the secondary chamber 100, the counter 140 signals the third cylinder assembly 128 to eject the nested complement from the secondary chamber 100. The second and fourth cylinder assemblies 126 and 160 are timed to first withdraw the angular stop member 124 and then to open the cover apparatus 142 to permit the nested complement to be ejected into the tray 141. After a time delay, the angular stop member 124 and the cover apparatus 142 return to their respective radially extended and closed positions for formation of the next nested complement of resilient members 14.

Advantageously, the handling apparatus 10 functions to permanently bow the resilient members 14 to thereby form arcuate springs, and to thereafter arrange the arcuate springs in nested relation to form a compact bundle or nested complement which can, if desired, be secured together with bands, twine, or the like, and which facilitates easier handling of the resilient members 14 during packaging, storage, treatment, or use.

Other features and advantages of the invention are set forth in the following claims.

We claim:

1. A nesting apparatus for positioning resilient members in nested relation, said nesting apparatus comprising a frame, means stationarily mounted on said frame for defining a primary chamber adapted to receive a resilient member, means fixed on said frame against movement relative to said frame for defining a secondary chamber adapted to receive resilient members from said primary chamber, means on said frame for feeding resilient members one at a time into said primary chamber, means on said frame for transferring resilient members one at a time from said primary chamber to said secondary chamber to form a nested complement of the resilient members in said secondary chamber, a closure adapted to contain the resilient members within said secondary chamber, and means for displacing said closure to a position affording removal of said resilient members from said secondary chamber.

2. A nesting apparatus as set forth in claim 1, wherein said means for defining said secondary chamber includes a cage member, and an ejector plate moveable within said secondary chamber and relative to said cage member, and adapted to eject the nested complement of resilient members from said secondary chamber.

3. A nesting apparatus as set forth in claim 1, wherein said primary chamber is generally cylindrical, and said secondary chamber is generally cylindrical and coaxially aligned with said primary chamber.

4. A nesting apparatus as set forth in claim 1, wherein said primary chamber has a chamber entryway, and said means for feeding includes a door positioned over said chamber entryway, and supported on said frame for pivotal movement relative thereto between an opened position wherein said door is adapted to direct a resilient member into said primary chamber through said chamber entryway, and a closed position.

5. A nesting apparatus as set forth in claim 4, wherein said door is adapted to engage successive resilient members so that said door is pivoted to said opened position as each resilient member is fed into said primary chamber.

6. A nesting apparatus as set forth in claim 1, wherein said nesting apparatus further comprises a stop member positionable within said secondary chamber, and adapted to engage each successive resilient member transferred to said secondary chamber to restrict angular movement thereof so that the successive resilient members nest in previously transferred resilient members to form the nested complement in said secondary chamber.

7. A nesting apparatus for positioning resilient members in nested relation, said nesting apparatus comprising a frame, means stationarily mounted on said frame for defining a primary chamber adapted to receive a resilient member, means stationarily mounted on said frame for defining a secondary chamber adapted to receive resilient members from said primary chamber, means on said frame for feeding resilient members one at a time into said primary chamber, and means on said frame for transferring resilient members one at a time from said primary chamber to said secondary chamber so as to form a nested complement of the resilient members in said secondary chamber, said means for transferring including a head member moveable between a retracted position wherein said head member is positioned in said primary chamber, and an extended position wherein said head member is positioned in said secondary chamber, said head member including a base, and an annular wall extending from said base, and having thereon a slot, said annular wall dividing said primary chamber into an outer portion and an inner portion when said head member is in said retracted position.

8. A nesting apparatus as set forth in claim 7, wherein said means for defining said primary chamber also defines a chamber entryway communicating with said primary chamber, and wherein said means for feeding includes a door supported on said frame for movement relative thereto between an opened position and a closed position, located at least partially over said chamber entryway, and adapted to direct resilient members into said outer portion of said primary chamber for travel around said annular wall and then through said slot and into said inner portion of said primary chamber.

9. A nesting apparatus as set forth in claim 7, wherein said means for transferring includes means for moving said head member between said retracted position and said extended position after each resilient member is fed into said primary chamber to transfer successive resilient members from said primary chamber to said secondary chamber.

10. A nesting apparatus as set forth in claim 9, wherein said means for feeding includes a door supported on said frame for pivotal movement between an opened position and a closed position, said door being adapted to engage successive resilient members so that said door is pivoted to said opened position as each resilient member is fed into said primary chamber, and wherein said means for transferring includes means for sensing the position of said door.

11. A nesting apparatus for positioning resilient members in nested relation, said nesting apparatus comprising a frame, means fixed on said frame against movement relative to said frame for defining a primary chamber adapted to receive a resilient member, means on said frame for defining a secondary chamber adapted to receive resilient members from said primary chamber, means on said frame for transferring resilient members one at a time from said primary chamber to said secondary chamber, means positionable within said secondary chamber for restricting angular movement of the resilient members transferred to said secondary chamber, a closure adapted to contain the resilient members within said secondary chamber, and means for displacing said closure to a position affording removal of said resilient members from said secondary chamber.

12. A nesting apparatus as set forth in claim 11, wherein said means for restricting angular movement includes a stop member adapted to engage each successive resilient member transferred to said secondary chamber to restrict angular movement thereof so that the successive resilient members nest in previously transferred resilient members to form a nested complement of the resilient members in said secondary chamber.

13. A nesting apparatus as set forth in claim 12, wherein said stop member is extendable radially into said secondary chamber.

14. A nesting apparatus as set forth in claim 11, wherein said primary chamber is generally cylindrical, and said secondary chamber is generally cylindrical and aligned coaxially with said primary chamber, each of said primary chamber and said secondary chamber being stationary and fixed relative to said frame.

15. A nesting apparatus for positioning resilient members in nested relation, said nesting apparatus comprising a frame, means on said frame for defining a primary chamber adapted to receive a resilient member, means on said frame for defining a secondary chamber adapted to receive resilient members from said primary chamber, means on said frame for transferring resilient members one at a time from said primary chamber to said secondary chamber and including a head member moveable between a retracted position wherein said head member is located within said primary chamber, and an extended position wherein said head member is located within said secondary chamber, said head member including a base, and an annular wall extending transversely from said base, defining an interior space, and having therein a slot, and means positionable within said secondary chamber for restricting angular movement of the resilient members transferred to said secondary chamber.

16. A nesting apparatus as set forth in claim 15, wherein said means for restricting includes a stop member radially extendable into said secondary chamber, and adapted to engage each successive resilient member as the resilient member unwraps from around said annular wall.

17. A nesting apparatus as set forth in claim 16, wherein said means for defining said secondary chamber includes a plate having therein an opening to accommodate passage of said head member into said secondary chamber, and wherein said plate is adapted to engage successive resilient members as the head member is retracted from said secondary chamber to assist in freeing each resilient member from said interior space of said head member.

18. A resilient member handling apparatus comprising a frame, means on said frame for bowing successive resilient members, and means for forming a nested complement of the resilient members, said means for forming including a first cage member stationarily mounted on said frame, and defining a primary chamber adapted to receive a resilient member, a second cage member fixedly mounted on said frame against movement relative to said frame, and defining a secondary chamber adapted to receive a plurality of the resilient members from said primary chamber, means on said frame for feeding resilient members one at a time into said primary chamber from said means for bowing, and means on said frame for transferring the resilient members one at a time from said primary chamber to said secondary chamber, a closure adapted to contain the resilient members within said secondary chamber, and means for displacing said closure to a position affording removal of said resilient members from said secondary chamber.

19. A handling apparatus as set forth in claim 18, wherein said means for bowing includes a die member having an arcuate surface portion, and means adjacent said arcuate surface portion for urging successive resilient members into engagement with said arcuate surface portion.

20. A handling apparatus as set forth in claim 18, wherein said means for feeding includes a door supported on said frame for pivotal movement between an opened position and a closed position, said door being adapted to engage successive resilient members so that said door is pivoted to said opened position as each resilient member is fed into said primary chamber.

21. A handling apparatus as set forth in claim 18, wherein said primary chamber is generally cylindrical, and said secondary chamber is generally cylindrical and coaxially aligned with said primary chamber.

22. A handling apparatus as set forth in claim 18, wherein said means for forming includes a stop member positionable within said secondary chamber, and adapted to engage each successive resilient member transferred to said secondary chamber to restrict angular movement thereof so that the successive resilient members nest in previously transferred resilient members to form the nested complement in said secondary chamber.

23. A resilient member handling apparatus comprising a frame, means on said frame for bowing successive resilient members, and means for forming a nested complement of the resilient members, said means for forming including a first cage member stationarily mounted on said frame, and defining a primary chamber adapted to receive a resilient member, a second cage member stationarily mounted on said frame, and defining a secondary chamber adapted to receive resilient members from said primary chamber, means on said frame for feeding resilient members one at a time into said primary chamber from said means for bowing, means on said frame for transferring resilient members one at a time from said primary chamber to said secondary chamber, said means for transferring including a head member moveable between a retracted position wherein said head member is located within said primary chamber, and an extended position wherein said head member is located within said secondary chamber, said head member including a base, and an annular wall extending from said base, and having therein a slot, said annular wall dividing said primary chamber into an outer portion and an inner portion when said head member is in said retracted position.

24. A resilient member handling apparatus comprising a frame, means on said frame for bowing successive resilient members, said means for bowing including a die member having an arcuate surface portion, and means adjacent said arcuate surface portion for urging successive resilient members into engagement therewith, and means for forming a nested complement of resilient members, said means for forming including a stationary first cage member fixed on said frame, said first cage member defining a generally cylindrical primary chamber adapted to receive a resilient member, and a chamber entryway communicating with said primary chamber, means for defining a generally cylindrical secondary chamber coaxially aligned with said primary chamber, said means for defining including a stationary second cage member fixed on said frame, and adapted to receive a plurality of resilient members, an ejector plate moveable within said secondary chamber relative to said second cage member between a complement retaining position and an ejecting position, said ejector plate having therein a central opening, and being adapted to eject the nested complement of resilient members from said secondary chamber, and a removeable cover adapted to selectively contain the resilient members within said secondary chamber, means on said frame for transferring resilient members one at a time from said primary chamber to said secondary chamber, said means for transferring including a head member moveable between a retracted position wherein said head member is positioned within said primary chamber, and an extended position wherein said head member is positioned within said secondary chamber, said head member including a base, and an annular wall extending from said base, having therein a slot, and dividing said primary chamber into an outer portion and an inner portion when said head member is in said retracted position, means for moving said head member through said central opening and between said retracted and extended positions, and means on said frame for feeding resilient members one at a time into said primary chamber from said means for bowing, said means for feeding including a door located at least partially over said chamber entryway, and supported on said frame for pivotal movement relative thereto between an opened position and a closed position, said door being adapted to engage successive resilient members so that said door is pivoted to said opened position as each resilient member is fed into said primary chamber, and to direct resilient members into said outer portion for travel around said annular wall and through said slot and into said inner portion, and a stop member radially extendable into said secondary chamber, said stop member being adapted to engage each successive resilient member transferred to said secondary chamber to restrict angular movement thereof so that successive resilient members nest in previously transferred resilient members to form the nested complement in said secondary chamber.

* * * * *